United States Patent [19]

Soled et al.

[11] Patent Number: 4,525,206

[45] Date of Patent: Jun. 25, 1985

[54] REDUCTION PROCESS FOR FORMING POWDERED ALLOYS FROM MIXED METAL IRON OXIDES

[75] Inventors: Stuart L. Soled, Madison, N.J.; Aaron Wold; Robert Kershaw, both of Providence, R.I.

[73] Assignee: Exxon Research & Engineering Co., Florham Park, N.J.

[21] Appl. No.: 620,943

[22] Filed: Jun. 15, 1984

Related U.S. Application Data

[63] Continuation of Ser. No. 564,467, Dec. 20, 1983, abandoned.

[51] Int. Cl.[3] ..... B22F 9/00

[52] U.S. Cl. ..... 75/0.5 BA

[58] Field of Search ..... 75/0.5 BA, 0.5 B, 0.5 R

[56] References Cited

U.S. PATENT DOCUMENTS

| | | | |
|---|---|---|---|
| 3,082,084 | 3/1963 | Alexander et al. | 75/206 |
| 3,152,389 | 10/1964 | Alexander et al. | 29/182.5 |
| 4,373,947 | 2/1983 | Büttner et al. | 75/0.5 BB |
| 4,477,277 | 10/1984 | D'Altilia et al. | 75/0.5 BA |

*Primary Examiner*—Wayland Stallard

*Attorney, Agent, or Firm*—Robert J. North

[57] ABSTRACT

Use of a strong reducing agent such as calcium metal allows complete reduction of refractory and difficulty reducible mixed metal iron oxides to form alloys. The powdered iron-based alloys can thus be prepared at significantly lower temperature than by the conventional melt technique.

13 Claims, No Drawings

REDUCTION PROCESS FOR FORMING POWDERED ALLOYS FROM MIXED METAL IRON OXIDES

This is a continuation of application Ser. No. 564,467 filed 12-20-83, now abandoned.

BACKGROUND OF THE INVENTION

1. Field of the Invention

This invention relates to a process for preparing powdered metal-based iron alloys, from mixed metal iron oxides by treatment with calcium as a reducing agent. The alloys are useful as Fischer-Tropsch catalysts for preparing hydrocarbons from CO and $H_2$.

2. Brief Discussion of the Prior Art

Calcium metal is known in the art, particularly in steelmaking, as being a strong reducing agent and has the ability to reduce many metal oxides to their respective metals. However, in powdered metal alloy formation, hydrogen gas is usually preferred as the reducing agent due to its ease of handling and also in view of the disadvantages associated with handling metallic calcium.

A general route used to prepare a number of powdered metal alloys consists of heating a mixture of at least two metallic components at temperatures in excess of 1500° C., i.e. above the melting point of either of the two elements. In some cases, mixed metal oxides, which are normally prepared by heating the component oxides, carbonates, or hydroxides, at temperatures near 100° C., and contain two or more different metal ions in close atomic proximity (about 10 Å), are easily reduced in hydrogen to an alloy at low temperatures (about 500° C.), since each oxide component itself reduces easily. This proves true in the case of Fe-Co oxides or Fe-Ni oxides for example. However, with other mixed metal oxides, such as Fe-Cr, Fe-Mn, Fe-Ti, and Fe-Zn types, high temperature (1000° C.) hydrogen reduction reduces either partially or all of the iron to iron metal leaving as a residue an oxide component, and does not generally result in substantially pure alloy as a product.

U.S. Pat. No. 4,373,947 describes a process for producing powdered titanium-based alloys from the calcium reduction of calcined mixture of titanium oxide and a second metal oxide. However, the disclosure does not suggest or teach the applicability of this type of process for preparing iron-based alloys from single phase mixed metal iron oxides.

What is desired in the art is an alternate method for effectively preparing powdered metal-based iron alloys directly by reduction of the corresponding mixed metal iron oxides, particularly where one of the mixed metal oxides is difficulty reducible, and where the reduction can be conducted at a lower temperature than the melting points of the respective metals or mixed metal oxide.

SUMMARY OF THE INVENTION

It has been found that metallic calcium is an effective reducing agent for reducing refractory mixed metal iron oxides to iron-based alloys, at reduction temperatures well below 1000° C., being below the melting points of either metal alone and the mixed metal oxide. A mild acid treatment removes the formed calcium oxide and calcium by-products and impurities formed during the mixed metal iron oxide reduction, leaving a powdered alloy. These alloys have applications in catalysis for $CO/H_2$ hydrocarbon synthesis.

In accordance with this invention there is provided a process for producing a powdered metal-based iron alloy comprising the steps of:

(a) heating a mixture comprised of a powdered mixed metal iron oxide, being difficulty reducible in hydrogen gas, and at least a stoichiometric amount of calcium metal, in a non-oxidizing atmosphere, at a temperature below the melting point of the mixed metal iron oxide, for a time sufficient to substantially reduce all of the metal oxide present and form said product metal-based iron alloy, as determined by X-ray diffractometry; and (b) contacting said reduced mixed metal iron oxide with aqueous acid to remove calcium impurities and by-products; and (c) recovering said product metal-based iron alloy.

Further provided by this invention is a process for preparing a powdered iron-manganese alloy comprising the steps of:

(a) heating a powdered iron-manganese spinel with at least a stoichiometric amount of metallic calcium at a temperature below the melting point of said spinel for a time sufficient to substantially reduce said spinel, and form said product alloy;

(b) contacting the reduced spinel from step (a) with aqueous acid to remove calcium impurities and by-products; and (c) recovering said product powdered iron-manganese alloy.

DESCRIPTION OF THE INVENTION AND PREFERRED EMBODIMENTS

The mixed metal iron oxides described and applicable in the present invention are generally single phase materials as determined by X-ray diffractometry in containing metals on one or more sites in the oxide lattice. The single phase can be determined readily by comparison with a simple mixture of the individual metal oxides. The metals can have coordination numbers of 2–12, usually 4 or 6, as in the case of tetrahedral or octahedral coordination sites. The metals are generally selected from the first row transition metals, from Groups IIB, IIIB, IVB, VB, VIB, and VIIB of the Periodic Table, i.e., scandium, titanium, vanadium, chromium, manganese and zinc. Preferably, the other metal in mixed metal iron oxide is selected from manganese, vanadium and chromium. A preferred metal oxide applicable in the instant process is a mixed metal oxide comprised of iron and manganese, preferably being an iron-manganese spinel.

The metals of the oxide are bonded directly to oxygen atoms and thus through oxygen to another metal atom. Generally, the oxides are corundum or spinel in crystal structure, as determined by X-ray diffractometry and preferably spinels.

The spinels have the following empirical formula: $Fe_xM_yO_4$, wherein M is selected from the first row transition metals group and wherein x and y are integer or decimal values, other than zero, and wherein the sum of $x+y$ is 3. This spinel crystal structure places the metals within a 10–15 Å proximity or less of their neighbors. The single phase oxide structure, e.g. spinel, presents an advantage to the use of a multiphase mixture of oxides in that, because of the close proximity and atomic mixing of the metal atoms in the single phase oxide, no separate alloying step is necessary after calcium reduction. Whereas, multiphase material requires a separate annealing/alloying step, after reduction, to aid diffusion of the separate metals together to form the alloy.

The mixed metal iron oxides applicable in the invention can be conveniently prepared by the high temperature solid state reaction of the component metal oxides, hydroxides, carbonates, bicarbonates, oxyhydroxides, sulfates, oxysulfates, chlorides or oxychlorides. Typically, the synthesis reaction of the mixed metal oxides proceeds at temperatures of 600°-1200° C., preferably between 800° and 1000° C., with several intermittent grindings or mixings between successive calcinations. The reactions can also be carried out in air, inert, or vacuum atmospheres.

When both metals in the mixed oxide as the respective oxides, are easily reducible by hydrogen, the corresponding alloys are generally prepared directly by reducing the mixed metal oxide in a hydrogen atmosphere at moderately low temperature. For example, the phase $CoFe_2O_4$, easily prepared from $Co_3O_4$ and $Fe_3O_4$, crystallizes in the spinel crystal structure. At a temperature of 500° C., hydrogen directly and substantially reduces this phase to an alloy of the composition $CoFe_2$. However, in many cases, one or both of the metal oxides present in the alloy do not easily reduce in the presence of hydrogen below 850° C., for example, iron-manganese mixed metal oxides, i.e. $Fe_{2.25}Mn_{0.75}O_4$.

According to the present invention, mixed metal iron oxides that are difficultly reducible or are not substantially reducible under high temperature conditions in hydrogen gas can be prepared at reaction temperatures much lower than that required to melt the mixed metal oxide or the two-component metals, generally being lower than 1000° C. This invention embodies the reduction of a mixed metal oxide, particularly spinels, at moderate temperatures below the melting point of the mixed metal oxide and those of the two component metals, by contacting said mixed metal oxide, with at least a stoichiometric amount of calcium metal to produce an alloy. The calcium metal can be in the form of a ribbon, powder, or other conveniently available and usable forms for the reduction process, including alloys or eutectics, e.g. calcium-silicon alloy, or eutectics which lower the melting point of the calcium metal.

These mixed metal iron oxides can be reduced by reaction with metallic calcium at moderate temperature. A quantity of calcium is employed, at least in the stoichiometric amount, and/or preferably in excess of about 5-10% on a molar basis, or greater, for ease and convenience in reduction, as determined by the following equation:

$$Fe_xM'_yO_4+4Ca \rightarrow Fe_xM'_y+4CaO$$

where M is a metal selected from Sc, Ti, V, Cr, Mn or Zn, and x and y are integer or decimal values wherein the sum of x+y is 3.

The spinels are prepared in a high temperature solid state sintering reaction in a temperature range of about 600° to 1000° C. between the respective component metal oxides and/or metals, in ambient atmosphere or under vacuum. Adequate description of a process for preparing Fe-Mn spinels is given in copending SN(C-1538), hereby incorporated by reference for that purpose. Spinels containing the other listed metals above can also be prepared by substantially the same process details.

The calcium is placed in contact with the mixed metal oxide in a container being usually of iron or nickel construction that can resist attack by metallic calcium or calcium oxide at high temperature. The reactants are placed in an non-oxidizing atmosphere, being either under an atmosphere or flow of an inert gas, for example, helium, argon, nitrogen and the like, or under reduced pressure as in a vacuum. The temperature is then raised to between 600°-1000° C., being lower than the melting point of the mixed metal oxide and preferably between 800°-900° C. Particularly preferred is where the process temperature is at the melting point of calcium metal, i.e., 845° C., or above such that the reduction takes place in a slurry of the mixed metal iron oxide in molten calcium. The mixture is reacted for between 1-100 hours, and preferably between 50-75 hours being dependent upon the particular reaction conditions used to substantially ensure complete reduction to the metal alloy. Following the reduction reaction, the calcium by-products, including calcium oxide and unreacted calcium, must be removed by leaching from the solid alloy. A dilute aqueous solution of a water soluble organic acid or mineral acid such as acetic acid, hydrochloric acid, nitric acid, and the like, in about a concentration of 1-2 Normal is contacted for a short period of time, e.g. about 10-20 minutes, with the impure obtained alloy from the reduction step. More concentrated or less concentrated aqueous acid solutions may also be used but 1-2 Normal is a convenient concentration of the acid to utilize. Following contact with the aqueous acid, the alloy is filtered off or removed from the aqueous solution and dried to recover and isolate the product alloy in substantially reduced and pure powdered form. The powdered form of the alloy usually has a surface area of about 0.1 to 5 $m^2/g$ with an attendant particle size of about 1-10 microns, which can be directly used in this particle size range in $CO/H_2$ hydrocarbon synthesis. The contacting step with the acid can be carried out conveniently at room temperature, or slightly elevated temperature, to ensure good mixing and extraction of the calcium by-products. Following the aqueous acid extraction, the resulting alloy is recovered as described hereinabove.

Further provided by this invention is a process for preparing a powdered iron-manganese alloy in which a powdered iron-manganese spinel is heated with at least a stoichiometric amount of calcium metal at a temperature of 600°-1000° C. under reaction conditions as described generally hereinabove. A preferred single phase spinel applicable in this embodiment is of the empirical formula: $Fe_{2.25}Mn_{0.75}O_4$, and the resulting alloy having the formula of: $Fe_{2.25}Mn_{0.75}$. Apparatus for carrying out the subject invention process as described herein is conventional and will be obvious to one skilled in the art from a reading of the examples herein and the accompanying disclosure.

The following examples should not be construed as being limitations on the scope or spirit of the instant invention and the examples are the best mode of carrying out the invention process as contemplated by us.

COMPARATIVE EXAMPLE

An iron-manganese oxide of stoichiometry, $Fe_{2.25}Mn_{0.75}O_4$, was synthesized by heating an intimately ground mixture of 1.5969 g., $Fe_2O_3$; 0.1396 g. Fe; and 0.5720 g. $Mn_3O_4$, in an evacuated sealed quartz tube at 1000° C. for 24 hrs. The resulting solid was reground and resealed in a new quartz tube, and then reheated 24 hrs. at 1000° C. An X-ray diffraction pattern established that the resulting material crystallized as a single phase product into a spinel crystal structure. Subsequent high temperature $H_2$ reduction at 1000° C., yielded a mixture of Fe metal plus MnO.

EXAMPLE 1

0.5 Gms of the $Fe_{2.25}Mn_{0.75}O_4$, prepared above, together with 0.7 gm metallic Ca (6 mesh) were placed into a 13 mm. O.D. iron tube and then placed into a quartz tube which was evacuated and then sealed (the iron tube was fitted with a plug such that the calcium or spinel did not contact the walls of the quartz tube), and reacted at 850° C. for 72 hours. After cooling, the contents were placed into about 300 ml. one Normal acetic acid solution at room temperature and stirred for about 3 hours to completely leach out CaO, calcium by-products, and unreacted calcium. The suspended solid alloy was filtered, washed with tap water until the washings were acid free and the resulting solid was air-dried. The powder X-ray diffraction pattern of the resulting solid phase indicated a face-centered cubic cell with a lattice constant of a=3.596 Å. The obtained solid was isostructural with gamma-Fe and a conventionally prepared Fe-Mn alloy from a procedure involving molten iron and manganese metals at temperatures in excess of 1500° C. The surface area of the Fe-Mn alloy obtained in this example was about 0.3 $m^2/gm$.

What is claimed is:

1. A process for producing a powdered metal-based iron alloy comprising the steps of: (a) heating a mixture comprised of a powdered mixed metal iron oxide, being difficulty reducible in hydrogen gas, with at least a stoichiometric amount of calcium metal, in a non-oxidizing atmosphere, at a temperature below the melting point of the mixed metal iron oxide for a time sufficient to substantially reduce all the metal oxide present, and form said product metal-based iron alloy, as determined by X-ray diffractometry; (b) contacting said reduced mixed metal iron oxide with aqueous acid to remove calcium impurities and by-products; and (c) recovering said product metal-based iron alloy.

2. The process of claim 1 wherein said temperature is in the range of about 600°-1000° C.

3. The process of claim 2 wherein said temperature is in the range of about 800°-900° C.

4. The process of claim 1 wherein said temperature is at about the melting point of calcium metal or higher.

5. The process of claim 1 wherein said non-oxidizing atmosphere is comprised of an inert gas or is under reduced pressure.

6. The process of claim 1 wherein said acid in step (b) is selected from acetic, nitric, or hydrochloric acids.

7. The process of claim 1 wherein said mixed metal oxide is a single phase oxide as determined by X-ray diffractometry.

8. The process of claim 1 wherein said mixed metal oxide is comprised of iron and at least one other metal selected from the first row transition metal series of Groups IIIB, IVB, VB, VIB, VIIB and IIB of the Periodic Table.

9. The process of claim 7 wherein said mixed metal oxide is comprised of iron and at least one metal selected from scandium, titanium, vanadium, chromium, manganese, or zinc.

10. The process of claim 1 wherein said mixed metal oxide is not completely reducible in hydrogen atmosphere at temperatures below 850° C.

11. The process of claim 1 wherein said product metal-based iron alloy has a BET surface area of about 0.1 to 5 $m^2/g$.

12. A process for preparing a powdered iron-manganese alloy comprising the steps of (a) heating a powdered iron-manganese spinel with at least the stoichiometric amount of metallic calcium at a temperature in the range of 600°-1000° C. for a time sufficient to substantially reduce said spinel and form said product alloy; (b) contacting the reduced spinel from step (a) with aqueous acid to remove calcium impurities and by-products; and (c) recovering said product powdered iron-manganese alloy.

13. The process of claim 12 wherein said mixed metal oxide is of the formula: $Fe_{2.25}Mn_{0.75}O_4$, and the reduced metal alloy produced is of the formula: $Fe_{2.25}Mn_{0.75}$, exhibiting an X-ray diffraction being isostructural with gamma iron.

* * * * *